United States Patent [19]

Harper, Jr. et al.

[11] 3,975,154

[45] Aug. 17, 1976

[54] PROCESS FOR PRODUCING AND UTILIZING DURABLE PRESS FABRICS WITH STRONG ACID GRAFTS

[75] Inventors: Robert J. Harper, Jr.; Gloria A. Gautreaux, both of Metairie; Joseph S. Bruno, Chalmette, all of La.

[73] Assignee: The United States of America as represented by the Secretary of Agriculture, Washington, D.C.

[22] Filed: June 9, 1975

[21] Appl. No.: 585,213

[52] U.S. Cl. ..... 8/116 P; 8/185; 8/DIG. 18

[51] Int. Cl.[2] ..... D06M 1/14; D06M 13/38; D06M 13/30

[58] Field of Search ..... 8/116 P, 185, DIG. 18

[56] References Cited

UNITED STATES PATENTS

| | | | |
|---|---|---|---|
| 2,610,953 | 9/1952 | Daul et al. | 8/116 P |
| 3,170,004 | 2/1965 | Farago | 8/DIG. 18 |
| 3,219,407 | 11/1965 | Sommer et al. | 8/185 |
| 3,377,249 | 4/1968 | Marco | 8/DIG. 18 |
| 3,778,226 | 12/1973 | Kissa | 8/185 |
| 3,788,804 | 1/1974 | Harper et al. | 8/185 |
| 3,796,540 | 3/1974 | Harper et al. | 8/185 |

FOREIGN PATENTS OR APPLICATIONS

| | | |
|---|---|---|
| 332,155 | 3/1972 | U.S.S.R. |

*Primary Examiner*—Donald Levy
*Assistant Examiner*—Maria S. Tungol
*Attorney, Agent, or Firm*—M. Howard Silverstein; David G. McConnell; Salvador J. Cangemi

[57] ABSTRACT

This invention relates to the preparation and use of durable press fabrics with strong acid grafts. The preparation is accomplished by the incorporation of a reactive hydroxyalkyl sulfonic or phosphinic acid in a crosslinking finishing system. As a consequence of this, durable press fabrics are produced with sulfonic or phosphinic acid grafts. Because of these strong acid grafts, these fabrics show improved moisture regain properties, can be dyed with basic dyes, can be whitened with basic optical brighteners and have ion exchange properties for metallic cations.

6 Claims, No Drawings

PROCESS FOR PRODUCING AND UTILIZING DURABLE PRESS FABRICS WITH STRONG ACID GRAFTS

This invention relates to treatments which impart wrinkle resistance to cellulosic textile materials. In particular, it relates to providing a method by which cotton and cellulosic containing fabrics may be finished, so that crosslinking and grafting can be performed at the same time. The reactive additives employed for grafting in this work possess strong acid groups. As a consequence of this operation, there are produced resilient fabrics in which the grafted moieties contain strong acid groups.

The presence of these strong acid groups as grafted moieties imparts to these fabrics additional properties not normally associated with crosslinked fabrics. For example, these fabrics can be dyed with basic dyes, can be whitened with basic optical brighteners, show good absorption characteristics for metallic cations (ion exchange properties) and have increased moisture regain characteristics. The latter property is associated with improved comfort characteristics of fabrics.

In essence, this invention relates to the incorporation of a reactive additive agent containing a strong acid group into a standard finishing formulation. Thus, the formulation would consist of the crosslinking agent, the acid catalyst, and the reactive agent. The reactive agent can be used either in the acid form or in the salt form. In either case, it may be necessary to adjust the pH of the solution to a specified value or range so that both the crosslinking agent and catalyst are still effective.

Examples of the hydroxyalkyl sulfonic and phosphinic acids employed in this research are 2-hydroxyethane sulfonic acid (A), 3-hydroxypropane sulfonic acid (B), bis(hydroxymethyl)phosphinic acid (C) or their corresponding salts.

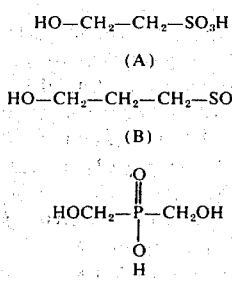

(A)

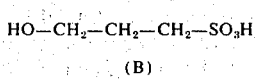

(B)

(C)

The hydroxyalkyl sulfonic and phosphinic acids can be used in amounts from 0.5% up to 10% in the finishing bath. With increasing amounts of the acid additives in the formulation, a progressive increase in the amount of acid groups grafted onto the fabric is observed.

The reason that this occurs is that the hydroxyl group of the hydroxy acid is reactive with the N-methylol moiety of the crosslinking agent. When another N-methylol group of the crosslinking agent. When another N-methylol group of the crosslinking agent reacts with cotton the hydroxy acid then becomes attached to cotton. In this respect, an agent such as dimethylol dihydroxyethyleneurea is a particularly effective crosslinking agent because it has four N-methylol groups available for the grafting of the hydroxy acids or available for crosslinking. As a result of using this agent and the hydroxyalkyl acid in finishing, one obtains a crosslinked fabric with high conditioned wrinkle recovery, with improved moisture regain characteristics, and with grafted strong acid groups.

In order to demonstrate the presence of these strong acid groups, three fabrics should be considered. One fabric is an untreated cotton fabric, the second is a fabric crosslinked in a conventional manner and the third is crosslinked with a hydroxy sulfonic acid or hydroxy phosphinic acid added to the finishing formulation. Swatches of each of these fabrics were then dyed with representative basic dyes such as Basic Violet 1, Color Index 42535; Basic Blue 9, Color Index 52015; Basic Red 22; Basic Blue 21; Basic Violet 10, Color Index 45170; and/or Basic Yellow 11, Color Index 98055.

After the various samples were laundered, the three members of each series treated with the dye were inspected. The conventionally crosslinked sample in each series was dyed a light shade, the untreated cotton sample was dyed a medium shade while the sample with the strong acid grafts was dyed a deep shade.

These results indicate the value and utility of the grafted acidic groups. Not only does the presence of these moieties increase the affinity of the cotton fabric for basic dyes but also it permits these fabrics to be dyed subsequent to crosslinking. The option of being able to dye after fabric has been crosslinked may have certain distinct marketing, processing and technical advantages. First, it would be possible to dye white goods a different color should a demand arise for special colored fabrics. Such an option might be advantageous for inventory control. Second, due to the high temperatures commonly used in textile finishing, the sublimation of dyestuffs occurs so that certain bright shades may be difficult to obtain. Also, the effects of metal salt catalysts and heat in causing undesirable shade changes might be easily corrected if fabric could be dyed after crosslinking. The fact that these fabrics could be dyed after finishing adds an element of flexibility that is not currently available in either processing conditions or choice of dyestuff. Finally, it would be possible to adjust fabric colors, due to undesirable shade changes occuring in curing or other steps.

In addition to the change in the dye characteristics of these fabrics, the presence of these acidic moieties influences other fabric properties. Thus, samples of the untreated fabric, conventionally finished fabric and the crosslinked fabric with the acidic grafts were treated with a solution containing an optical brightener having the characteristics of a cationic or basic dyestuff. There was a distinct difference in the response of these fabrics to the brightener.

In general, the crosslinked control shows poor absorption, the untreated cotton sample shows good absorption and the crosslinked sample with the acidic grafts shows absorption characteristics from slightly less than to somewhat better than the untreated cotton sample. These results can be observed visually under white light, by inspection under U.V. light or by measurement of the fluorescence of the various samples. Thus, under U.V. light, the crosslinked control was grey while the untreated cotton and the crosslinked sample with the grafted acidic groups were white.

In order to place evaluation on a numerical basis, the fluorescence values of the various samples at the point of maximum absorption were measured using a Farrand Spectrofluorometer. The fluorescence value of one sample in the group was given a value of 100%, the other members of the series were then given a value expressed as a percentage of this sample. A series of samples was treated with a bath containing Fluorescent Brightener 158, the samples were laundered and then the relative fluorescence values of the various samples were then measured. Under these circumstances the relative fluorescence value of the crosslinked control was 19%, that of the untreated cotton was 44% while that of crosslinked fabric with the hydroxypropane sulfonic acid graft ranged from 69–99% and that of the crosslinked fabric with the hydroxyethyl sulfonic acid graft ranged from 63-100%. Analogous results have been observed with other basic brighteners.

Because brighteners are usually added prior to crosslinking and because the conventionally finished fabrics usually exhibit poor absorption characteristics for optical brighteners, long term whiteness of crosslinked fabrics is generally a problem. Addition of the brightener prior to crosslinking gives good initial whiteness but optical brighteners are sensitive to light, heat, bleaches, and leaching out during laundering. As such, there is a distinct advantage in being able to renew the whiteness of textile fabrics subsequent to crosslinking. This approach of producing a crosslinked fabric with strong acid groups grafted onto it and the subsequent treatment of the fabric with a solution containing a basic optical brightener provides a route for whitening these fabrics at any time subsequent to crosslinking.

Another possible use for these fabrics are as cationic ion exchange resins. Thus, it was found that when various samples of untreated, conventionally crosslinked cotton and crosslinked cotton with strong acid grafts, were exposed to solutions containing metallic cations, there was better absorption of the metallic ions by the fabrics with grafted acid groups. As a consequence of this, these fabrics can have utility two ways. First, one can produce fabrics with a metallic ion content. Such fabrics with ion content can be useful for rot resistance, subsequent dye absorbtivity or for other purposes. The second purpose of the ability of these fabrics to selectively absorb metallic cations, is that it may be useful for ion exchange purposes. Such behavior can be valuable for recovery of metallic ions from aqueous solutions. This may be of value both for economic recovery and for pollution control purposes. Examples of such ion exchange properties of these various fabrics can be seen in the following cases. Thus, when a crosslinked control sample and a crosslinked sample with a sulfonic acid graft (produced by reaction of 9% dimethylol dihydroxyethyleneurea, zinc nitrate catalyst and 10% hydroxypropane sulfonic acid) were treated with a bath containing 4% copper ammonium sulfate, and then washed, the crosslinked control had 0.28% copper content on analysis while the sample with the sulfonic acid graft had 1.21% copper content. When a nickel ammonium bath was used instead of the copper solution, the values were 0.17% nickel content for the crosslinked control compared to 0.76% nickel for the crosslinked sample containing the grafted sulfonic acid moieties. Several crosslinked samples in which a high concentration of grafted phosphinic acid was present in the fabric were treated with an ammoniacal copper sulfate. The fabrics with the phosphinic acid grafts had copper contents ranging from 1.3 to 1.8% compared to 0.6% for the untreated cotton fabric. The formation of the copper complex in the fabric had a positive effect on the performance of these fabrics in the match flame test. Thus, in one case, fabric using bis(hydroxymethyl) phosphinic acid as the grafting acid had a 45° performance in the match test. After treatment with the copper containing solution, the fabric showed 1.47% copper and tested 135° in the match test. A value in excess of 90° is normally associated with flame retardant fabrics.

Another property normally associated with these crosslinked fabrics with strong acid groups is improved moisture regain characteristics. Crosslinking of cotton fabrics is normally accompanied by a reduction in moisture regain values. Thus, untreated cotton fabric had a moisture regain of 6.4% while the conventional crosslinked control had a value of 3.7%. With from 1% to 10% 3-hydroxy-1-propanesulfonic acid in the finish, the fabric moisture regain varied from 3.9 to 5.9%.

Similarly, with from 1 to 10% of hydroxyethylsulfonic acid in the finish the moisture regain varied from 4.1 to 6.1%. In a like manner, when fabric was treated with crosslinking agent and from 1 to 3% of bis(hydroxymethyl)phosphinic acid, the mositure regain values ranged from 4.6 to 5.7%.

An increase in moisture regain characteristics is normally associated with improved comfort characteristics and treatments which increase the moisture regain should make the fabrics more comfortable. This latter characteristic is an important factor in blended fabrics, because of the low regain characteristics of the untreated polyester fibers.

Concentration of Agent in Pad Bath

The total amount of grafted acid moieties increases progressively as the concentration of hydroxyalkyl sulfonic or hydroxyalkyl phosphinic acid in the finishing bath is increased. Sulfonic and phosphinic acid concentrations ranging from 1 to 15% have been employed, but a concentration from about 2–5% would seem to be preferred if cost versus overall effectiveness is considered.

To summarize, this invention can best be described as a method for producing crosslinked cotton and cellulosic containing fabrics containing grafted strong acid groups in a single finishing step. This is accomplished by the addition of a hydroxyalkyl sulfonic or hydroxyalkyl phosphinic acid or their salts to a standard finishing solution. The only other agents used are simple acids or bases, which are used to bring the pH of the bath to a point where the chemical agents are active.

Because of the strong acid groups on these fabrics, it is now possible to dye the fabrics with basic dyes, whiten them with basic optical brighteners and absorb metal ions from solutions and otherwise function as cation exchange resins. Also, because of the hydrophilic nature of these strong acid groups, these fabrics show improved moisture regain characteristics.

EXAMPLE 1

Cotton printcloth was padded with a solution containing 9 parts dimethylol dihydroxyethyleneurea, 0.5 part zinc nitrate hexahydrate and 90.5 parts of water. The fabric was dried for 7 minutes at 60°C and cured for 5 minutes at 160°C. The fabric was then laundered and tumble dried. Several other samples of cotton printcloth were likewise treated with the same formulation except that an appropriate amount of water in the finish was replaced by 1, 3, 5, and 10 parts of 3-hydroxy-1-propanesulfonic acid, sodium salt and sufficient 5% HCl to alter the pH of the solution to 5 to 6 before the addition of zinc nitrate and dimethylol dihydroxyethyleneurea. These samples were then dried, cured, and laundered as in the previous case. Some of the properties of the resultant fabrics are listed in Table 1. These values indicate that all the treated fabrics had good conditioned wrinkle recovery angles, progressively higher add-ons with increasing amounts of sulfonic acid in the finish and progressively higher moisture regain values with greater amounts of sulfonic acid in the finish. Elemental analyses showed that the sample with 5% 3-hydroxy-1-propane sulfonic acid in the finish had 0.55% sulfur content while that with 10% of the same acid in the finish had a 0.70% sulfur content.

TABLE I

Properties of Crosslinked Fabrics with Varying Amounts of 3-Hydroxy-1-propanesulfonic Acid in the Finish

| %[1] Sulfonic Acid | Cond. Wrinkle Recovery Angle (W+F) | % Add-on | % Moisture Regain |
|---|---|---|---|
| 0 | 288 | 4.3 | 3.7 |
| 1 | 289 | 5.7 | 3.9 |
| 3 | 288 | 8.1 | 4.3 |
| 5 | 283 | 9.9 | 4.7 |
| 10 | 265 | 12.1 | 5.9 |
| Untreated Cotton | 175 | 0 | 6.4 |

[1]All treated samples had 9 parts dimethylol dihydroxyethyleneurea, 0.5 part zinc nitrate hexahydrate, the indicated amount of sulfonic acid and sufficient water to make 100%.

EXAMPLE 2 another series of fabrics were treated in the same manner as in Example 1 except that the sulfonic acid reactive additive was hydroxyethyl sulfonic acid, sodium salt. After these fabrics had been laundered, the properties of these fabrics were measured. These values are listed in Table II. These values indicate that all of the treated fabrics have good conditioned wrinkle recovery angles, progressively higher add-ons with increasing amounts of sulfonic acid in the finish and progressively higher moisture regain values with greater amounts of sulfonic acid in the finish. Elemental analyses showed that the sample with 5% hydroxyethyl sulfonic acid in the finish had 0.67% sulfur content while that with 10% hydroxylethyl sulfonic acid had 1.1% sulfur content.

TABLE II

Properties of Crosslinked Fabrics with Varying Amounts of Hydroxyethyl Sulfonic Acid in the Finish

| %[1] Sulfonic Acid | Cond. Wrinkle Recovery Angle (W+F) | % Add-on | % Moisture Regain |
|---|---|---|---|
| 0 | 291 | 4.8 | 3.9 |
| 1 | 286 | 6.4 | 4.1 |
| 3 | 291 | 8.8 | 4.4 |
| 5 | 277 | 10.6 | 4.9 |
| 10 | 274 | 14.1 | 6.1 |
| Untreated Cotton | 188 | 0 | 6.4 |

[1]All treated samples had 9 parts dimethylol dihydroxyethyleneurea, 0.5 part zinc nitrate hexahydrate, the indicated amount of sulfonic acid and sufficient water to make 100%.

EXAMPLE 3 cotton printcloth was padded with a solution containing 9 parts dimethylol dihydroxyethyleneurea, 3 parts of a buffered zinc nitrate solution and 88 parts of water. The fabric was dried for 7 minutes at 60°C and cured for 15 minutes at 125°C. The fabric was then laundered and tumble dried. Several other samples of cotton printcloth were likewise treated with the same formulation except that an appropriate amount of water in the finish was replaced by 1, 2, and 3 parts of bis(hydroxymethyl) phosphinic acid and adjusting pH to 2 with potassium carbonate before addition of crosslinking agent and catalyst. These fabrics were then dried, cured and laundered as in the previous case. Another sample was treated with 10.8 parts of dimethylol dihydroxyethyleneurea, 4 parts of zinc nitrate hexahydrate and 15 parts of bis(hydroxymethyl) phosphinic acid and 60.2 parts of water. The fabric was then dried, cured and laundered as in the previous case.

TABLE III

Properties of Crosslinked Fabrics with Varying Amounts of Bis(Hydroxymethyl)Phosphinic Acid in the Finish

| DMDHEU[1] | % Modified Zinc Nitrate | % Phosphinic Acid | Cond. Wrinkle Recovery Angle(W+F) | % Add-on | % Moisture Regain |
|---|---|---|---|---|---|
| 9.0 | 3 | 0 | 302 | 6.1 | 4.3 |
| 9.0 | 3 | 1 | 300 | 7.3 | 4.6 |
| 9.0 | 3 | 2 | 280 | 9.8 | 5.6 |
| 9.0 | 3 | 3 | 278 | 8.5 | 5.7 |
| 10.8 | 4 | 15 | 276 | 19.4 | 6.0 |
| Untreated Cotton | | | 185 | 0 | 6.5 |

[1]Dimethylol dihydroxyethyleneurea.

EXAMPLE 4

The series of samples from Example 1 were inserted into a solution containing 1.2% methyl violet (Basic Violet 1, Color Index 42535) and 1% hydrochloric acid. The samples were treated for 20 minutes at room temperature and 20 minutes at 45°C. They were then rinsed repeatedly in distilled water. The untreated control and crosslinked control were dyed a pale splotchy blue. The samples with the sulfonic acid grafts were dyed a progressively deeper purple with increasing amounts of the sulfonic graft in the finish. The fact that this occurred attests to the increasingly acidic character of the fabric with the larger amounts of the 3-hydroxy-1-propane sulfonic acid in the finish.

The same series of fabrics were dyed with 1% methylene blue (Basic Blue 9, Color Index 52015). The dye bath contained 1% dye (methylene blue chloride) and the samples were dyed for 40 minutes at room temperature followed by a 35 minute period while the bath temperature was raised to 60°C. The fabrics were dyed a light blue for the crosslinked control followed by a progressive deepening of color shade as the amount of sulfonic acid in the finish increased. The increasing affinity of these basic dyes for these grafted fabrics attests to the increasing amount of sulfonic acid grafts on these fabrics arising from reactive additive hydroxypropyl sulfonic acid.

Representative samples from Examples 1 and 2 were dyed with 1% dye solution of Basic Blue 21 and Basic Yellow 11 (Color Index 98055). In each case, the samples were inserted in a dye bath containing 1% dye, the bath heated for 30 minutes at 50°–55°C, then washed repeatedly in distilled water and tumble dried. In each series, the fabrics were dyed a much deeper shade with the basic dye when a hydroxyalkyl sulfonic acid was used in finishing. In each instance, the crosslinked control was dyed a light shade. The increasing affinity for these basic dyes for the fabrics in which the sulfonic acid was used in finishing further demonstrates that grafted acidic moieties are produced on the fabric by the reaction of dimethylol dihydroxyethyleneurea and the hydroxyalkyl sulfonic acids.

Samples of the swatches dyed with methylene blue were also subjected to repetitive laundering. In one series used, a warm water wash was employed while in the other a hot water wash was employed. While gradual leaching of dye was observed, a shade differential was maintained for the samples with and without sulfonic acid grafts. In the case of the warm water wash, 50 laundry cycles were employed while in the case of the hot water wash, 30 laundry cycles were employed.

EXAMPLE 5 representative samples from Examples 1 and 2 were treated with basic optical brighteners. In the case of Optical Brightener DBS, the bath solution was prepared using 0.5 part Brightener DBS, 0.5 part glacial acetic acid and 99 parts of distilled water. The samples were treated in the bath for 40 minutes at 30°C, then rinsed repeatedly in distilled water. In the case of Brightener ACA, the treating bath consisted of 0.5 part Brightener ACA, 1 part glacial acetic acid and 98.5 parts water. The samples were padded with this solution twice, then rinsed repeatedly in distilled water. In the case of Fluorescent Brightener 158, the bath consisted of 0.5 part Brightener 158 and 99.5 parts water. The samples were placed in the solution and the bath was warmed at 45°–55°C for 45 minutes. The samples were washed repeatedly in distilled water, then laundered on the wash-wear cycle. As the data in Tables IV, V, and VI indicate, the samples which had grafted acidic groups had much higher relative reflectance values than the crosslinked control without any grafted acidic groups. The higher reflectance values of course correspond to better absorption of optical brightener, which in turn relates to better sample whiteness under both regular light and U.V. light. These results demonstrate, therefore, that the production of a strong acidic graft on fabric followed by treatment of the fabric with a basic optical brightener represents a viable process for the whitening of crosslinked fabrics subsequent to crosslinking.

TABLE IV

Relative Fluorescence of Sulfonic Acid Grafted Fabrics with Fluorescent Brightener DBS

| % DMDH-EU | % Zinc Nitrate | % Sulfonic Acid | Type[1] Acid | Relative Fluorescence |
|---|---|---|---|---|
| 9 | 0.5 | None | — | 26 |
| 9 | 0.5 | 2 | A | 72 |
| 9 | 0.5 | 5 | A | 100 |
| 9 | 0.5 | 10 | A | 89 |
| 9 | 0.5 | 2 | B | 56 |
| 9 | 0.5 | 5 | B | 86 |
| 9 | 0.5 | 10 | B | 102 |
| | Untreated Cotton | | — | 100 |

[1]Acid A is hydroxyethyl sulfonic acid while Acid B is hydroxypropyl sulfonic acid.

TABLE V

Relative Fluorescence of Sulfonic Acid Grafted Fabrics with Fluorescence Brightener ACA

| % DMDH-EU | % Zinc Nitrate | % Sulfonic Acid | Type[1] Acid | Relative Fluorescence |
|---|---|---|---|---|
| 9 | 0.5 | None | — | 23 |
| 9 | 0.5 | 2 | A | 41 |
| 9 | 0.5 | 5 | A | 46 |
| 9 | 0.5 | 10 | A | 73 |
| 9 | 0.5 | 2 | B | 46 |
| 9 | 0.5 | 5 | B | 53 |
| 9 | 0.5 | 10 | B | 67 |
| | Untreated Cotton | | — | 100 |

[1]Acid A is hydroxyethyl sulfonic acid while Acid B is hydroxypropyl sulfonic acid

TABLE VI

Relative Fluorescence of Sulfonic Acid Grafted Fabrics with Fluorescence Brightener 158

| % DMDH-EU | % Zinc Nitrate | % Sulfonic Acid | Type[1] Acid | Relative Fluorescence |
|---|---|---|---|---|
| 9 | 0.5 | None | — | 19 |
| 9 | 0.5 | 2 | A | 63 |
| 9 | 0.5 | 5 | A | 69 |
| 9 | 0.5 | 10 | A | 100 |
| 9 | 0.5 | 3 | B | 69 |
| 9 | 0.5 | 5 | B | 99 |
| | Untreated Cotton | | | 44 |

[1]Acid A is hydroxyethyl sulfonic acid while Acid B is hydroxypropyl sulfonic acid.

EXAMPLE 6

Two sets of samples from Example 3 were treated with optical brighteners. One set was treated with 0.5 part Fluorescent Brightener 158 and 99.5 parts water at pH 5 for a period of 45 minutes at 45°–55°C. The samples were then rinsed in distilled water several times and then tumble dried.

a second series was treated with 0.5 part basic optical brightener, Phorwhite DBS and 99.5 parts water at pH 4 for 40 minutes at 30°C. The samples were then rinsed repeatedly in distilled water. The fluorescence of the various samples are reported in Tables VII and VIII. It can be readily seen that the presence of these phosphinic acid groups has a positive effect on increasing the absorption of basic optical brighteners by these fabrics. Because of the increase in optical brightener absorption, the fabrics with grafted acidic moieties are whiter under both regular and U.V. light than the conventionally crosslinked control samples.

TABLE VII

Relative Fluorescence of Samples Treated with Fluorescence Brightener DBS

| % DMDHEU[1] | % Zinc Nitrate | % Phosphinic[2] Acid | Relative[3] Fluorescence |
|---|---|---|---|
| 9 | 3 | 0 | 25 |
| 9 | 3 | 1 | 40 |
| 9 | 3 | 2 | 98 |
| 9 | 3 | 3 | 92 |
| | Untreated Cotton | | 100 |

[1]Dimethylol dihydroxyethyleneurea
[2]Bis(hydroxymethyl) phosphinic acid
[3]Fluorescence value of the untreated cotton sample was given an arbitrary value of 100%, while the value of the other samples are expressed as a percent of this value.

TABLE VIII

Relative Fluorescence of Samples Treated with Fluorescence Brightener 158

| % DMDHEU[1] | % Zinc Nitrate | % Phosphinic[2] Acid | Relative Fluorescence[3] |
|---|---|---|---|
| 9 | 3 | 0 | 24 |
| 9 | 3 | 1 | 41 |
| 9 | 3 | 2 | 120 |
| 9 | 3 | 3 | 100 |
| | Untreated Cotton | | 76 |

[1]Dimethylol dihydroxyethyleneurea
[2]Bis(hydroxymethyl)phosphinic acid
[3]Fluorescence value of one member of a series was given an arbitrary value of 100%, while the value of the others are expressed as a percent of this value.

EXAMPLE 7

A series of fabrics from Example 3 were immersed in a solution prepared from 4 parts copper sulfate, 10 parts concentrated ammonium hydroxide, and 86 parts water. The samples were left in the solution for 15 minutes at room temperature, then rinsed repeatedly in distilled water and tumble dried. As the data in Table IX indicate, there is a marked increase in the copper content of the fabrics with the grafted acid groups relative to both the crosslinked control and the untreated cotton. A similar procedure was employed using 4 parts silver nitrate, 8 parts concentrated ammonium hydroxide and 88 parts water. As the data in Table IX indicate, a sharp increase in the silver content of the fabrics with the grafted acid groups was observed.

These two experiments readily indicate that this process produces crosslinked fabrics with grafted acid groups, which have ion exchange properties. Because of these ion exchange properties, it is possible to remove a metal ion from solution or to produce a fabric with a certain content of metal ions. A use for this property was observed for the sample treated with 10.8% DMDHEU, 4% zinc nitrate based catalyst and 15% phosphinic acid. Prior to treatment with the copper ammonia complex solution, the sample showed a performance of 45° in the match test. (Flame test employed in which sample is ignited at the bottom, in the vertical state and the sample is rotated 180° to see whether it burns out. In this test, 0° is a complete failure while a value of 90° or better is generally associated with passing performance in the vertical flame test). After treatment with the copper ammonia complex, this sample had a value of 135° in the match test, which is more than enough to give adequate flame retardancy.

TABLE IX

Ion Exchange Properties of Fabrics with Grafted Phosphinic Acid Groups

| Crosslinking Treatment | | | Metal Ion Content[1] | |
|---|---|---|---|---|
| % DMDHEU[2] | % Zinc Nitrate | % Acid[3] | % Copper | % Silver |
| 9.0 | 3 | 0 | 0.18 | 1.10 |
| 9.0 | 3 | 2 | 0.82 | 2.78 |
| 9.0 | 3 | 3 | 0.98 | 1.80 |
| 10.8 | 4 | 15 | 1.33 | — |
| | Untreated Cotton | | 0.49 | 0.25 |

[1]Metal ion contents of fabric were determined by X-ray fluorescence of samples after treatment with their respective metal ammine baths.
[2]Dimethylol dihydroxyethyleneurea
[3]Bis(hydroxymethyl)phosphinic acid

EXAMPLE 8

Samples of fabrics finished in a similar manner to those in Example 1 were treated with solutions containing copper ammonium, cobalt ammonium and nickel ammonium complexes as in Example 7. The copper bath contained 4 parts copper sulfate, 10 parts concentrated ammonium hydroxide and 86 parts water. The cobalt bath contained 4 parts cobalt sulfate, 8 parts concentrated ammonium hydroxide and 88 parts water. The nickel bath contained 4 parts nickel sulfate, 8 parts concentrated ammonium hydroxide and 88 parts water. The appropriate test results are given in table X and clearly indicate preferential absorption of the metallic ions by the fabrics with the grafted sulfonic acid groups relative to that achieved by the crosslinked control with no grafted sulfonic acid groups. These experiments further illustrate the ion exchange properties of these fabrics.

TABLE X

Ion Exchange Properties of Fabrics with Grafted Sulfonic Acid Groups

| Crosslinking Treatment | | | Metal Ion Content[1] | | |
|---|---|---|---|---|---|
| % DMDHEU[2] | % Zinc Nitrate | % Acid[3] | % Copper | % Cobalt | % Nickel |
| 9 | 0.5 | 0 | 0.28 | 0.12 | 0.17 |
| 9 | 0.5 | 5 | 0.96 | 0.24 | 0.53 |
| 9 | 0.5 | 10 | 1.21 | 0.49 | 0.76 |

[1]Metal ion contents of fabric were determined by X-ray fluorescence of samples after treatment with their respective metal ammine baths.
[2]Dimethylol dihydroxyethyleneurea
[3]3-Hydroxypropane, sulfonic acid

We claim:

1. A process for preparing a crosslinked cellulosic fabric possessing strong acid grafted groups, the process comprising:

a. impregnating the cellulosic textile with a formulation consisting of about from 1% to 15% of the crosslinking agent dimethylol dihydroxyethyleneurea, dihydroxyethyleneurea, 0.1to 4% of a zinc nitrate base catalyst and from 1% to 10% of a hydroxyalkyl sulfonic or hydroxyalkyl phosphinic acid salt, b. drying the wet impregnated textile from about 2 minutes to 2 hrs. at temperatures from 25° to 100°C, c. curing the dry impregnated textile about from 100°C to 200°C for periods of 20 seconds to 30 minutes, using longer periods of time with the lower temperatures, d. washing the cured fabric free of excess reagents.

2. The product prepared by the process of claim 1.

3. A process for preparing a crosslinked cellulosic fabric dyed with a basic dye, comprising:

a. impregnating the cellulosic textile with a formulation consisting of about from 1% to 15% of the crosslinking agent dimethylol dihydroxyethyleneurea, 0.1% to 4% of a zinc nitrate base catalyst and from 1% to 10% of a hydroxyalkyl sulfonic or hydroxyalkyl phosphinic acid salt, b. drying the wet impregnated textile from about 2 minutes to 2 hrs. at temperatures from 25° to 100°C, c. curing the dry impregnated textile about from 100°C to 200°C for periods of 20 seconds to 30 minutes, using longer periods of time with the lower temperatures, d. washing the cured fabric free of excess reagents, e. dyeing the washed fabric with a dye bath containing a basic dye using standard dye procedures, f. washing the fabric free of excess reagents.

4. The product prepared by the process of claim 3.

5. A process for preparing a crosslinked cellulosic fabric whitened with a basic or cationic optical brightener, comprising:

a. impregnating the cellulosic textile with a formulation consisting of about from 1% to 15% of the crosslinking agent dimethylol dihydroxyethyleneurea, 0.1% to 4% of a zinc nitrate base catalyst and from 1% to 10% of a hydroxyalkyl sulfonic or hydroxyalkyl phosphinic acid salt, b. drying the wet impregnated textile from about 2 minutes to 2 hrs. at temperatures from 25° to 100°C, c. curing the dry impregnated textile about from 100°C to 200°C for periods of 20 seconds to 30 minutes, using longer periods of time with the lower temperatures, d. washing the cured fabric free of excess reagents, e. treating the washed fabric from (d) with a solution containing about 0.5 weight percent of a basic or cationic optical brightener.

6. The product produced by the process of claim 5.

* * * * *